US006799763B2

(12) United States Patent
Grady

(10) Patent No.: US 6,799,763 B2
(45) Date of Patent: Oct. 5, 2004

(54) MODIFIED CHESS GAME

(75) Inventor: Brian Grady, Niagara-on-the-Lake (CA)

(73) Assignee: Dragon Chess Inc., Niagara-On-The-Lake ( * ) Notice: Subject to any disclaimer, the term of this patent is extended or adjusted under 35 U.S.C. 154(b) by 0 days.

(21) Appl. No.: 09/985,511

(22) Filed: Nov. 5, 2001

(65) Prior Publication Data

US 2003/0085521 A1 May 8, 2003

(51) Int. Cl.[7] ..... A63F 3/02
(52) U.S. Cl. ..... 273/260; 273/261
(58) Field of Search ..... 273/242, 236, 273/261, 260, 263; D21/348, 349, 334, 337; 434/128, 365

(56) References Cited

U.S. PATENT DOCUMENTS

| | | | | |
|---|---|---|---|---|
| 1,134,922 A | | 4/1915 | Smtih | |
| 1,555,937 A | | 3/1925 | Billman | |
| 2,045,339 A | | 6/1936 | Boland | |
| 2,614,842 A | | 10/1952 | Rice | |
| 3,843,130 A | | 10/1974 | Whitney | |
| D241,358 S | | 9/1976 | Benson | |
| 4,147,360 A | | 4/1979 | Bailey et al. | |
| 4,190,254 A | | 2/1980 | Leeds | |
| 4,249,741 A | | 2/1981 | Buijtendorp | |
| 4,708,349 A | | 11/1987 | Shomer | |
| 5,125,666 A | * | 6/1992 | Adams | 273/261 |
| D360,233 S | | 7/1995 | Jones | |
| 5,582,410 A | | 12/1996 | Hunt | |
| 5,690,334 A | * | 11/1997 | Duke | 273/261 |
| 5,803,457 A | * | 9/1998 | Smith | 273/261 |
| 6,095,523 A | * | 8/2000 | Lampman | 273/260 |
| 6,098,982 A | * | 8/2000 | Campusano | 273/261 |
| 6,102,399 A | * | 8/2000 | Kifer | 273/261 |
| 6,116,602 A | * | 9/2000 | McLoy | 273/261 |

OTHER PUBLICATIONS

Website:chessvariants.com.*

* cited by examiner

*Primary Examiner*—Jessica Harrison
*Assistant Examiner*—Alex F. R. P. Rada, II

(57) ABSTRACT

The present invention relates to a modified chess game for two players comprising a chessboard having a central section having a first side and a second side, said central section containing squares arranged in vertical rows and horizontal rows, and a first field section located along the first side of said central section and a second field section located along the second side of said central section, wherein each of said first and second field sections contain squares arranged in vertical rows and horizontal rows; preferably at least twenty playing pieces for each player consisting of ten pawns, one king, one queen, two rooks, two bishops, two knights and at least two additional pieces. In a preferred embodiment the two additional pieces are identical and can move a maximum of three squares in any direction. The additional pieces are preferably adapted to represent dragons.

9 Claims, 3 Drawing Sheets

(1 of 3 Drawing Sheet(s) Filed in Color)

MODIFIED CHESS GAME

BACKGROUND OF THE INVENTION

1. Field of the Invention

This invention relates to the game of chess and in particular the present invention provides a new variation on the classic game of chess.

2. Description of the Prior Art

Chess is a game, usually for two players, that involves a checkered board and specially designed pieces. The chessboard consists of 64 squares, alternately colored light and dark, arranged in eight vertical rows and eight horizontal rows. Each opponent has 16 pieces or men, one set light in color for the white side, and one set dark for the black side. The first row of each player's side of the board is occupied by pieces distinguished by their shape into five kinds: King, Queen, Rook, Bishop and Knight. The men in front of these pieces, positioned in the second row, are called pawns. Each player moves in accordance with fixed restrictions on the movement of each type of piece. The object is to force the opponent's principal piece, the King, into a position where it can not escape capture (checkmate).

Chess has been characterized as an intellectual game and traces its roots back to the $6^{th}$ century AD. Much time has been spent, postulating strategies and counter-strategies for successfully playing the game.

Several variations on the classic game have been proposed from time to time but none has yet proven to be as popular as the classic game. A new modification that retains the features of the classic game but changes the complexity, dynamics and strategy is needed to present new challenges to chess players young and old.

SUMMARY OF THE INVENTION

It is an object of the invention to provide a new modification that retains the features of the classic game but changes the complexity, dynamics and strategy.

Thus in accordance with the present invention there is provided a chessboard having a central section having a first side and a second side. The central section contains more than sixty-four squares, preferably one hundred squares, arranged in vertical rows and horizontal rows. A first field section is located along the first side of said central section and a second field section is located along the second side of said central section. Each of said first and second field sections contain squares arranged in vertical rows and horizontal rows. In a preferred embodiment the first and second field sections comprise twelve squares arranged in three vertical rows and four horizontal rows, centrally located along the first and second side of said central section. In a further preferred embodiment the eight vertical rows and eight horizontal rows in the central section containing sixty four squares are highlighted to permit the board to be used to play a traditional game of chess.

In another aspect the present invention provides a modified chess game for two players comprising a chessboard having a central section having a first side and a second side, said central section containing squares arranged in vertical rows and horizontal rows, and a first field section located along the first side of said central section and a second field section located along the second side of said central section, wherein each of said first and second field sections contain squares arranged in vertical rows and horizontal rows; preferably at least twenty playing pieces for each player consisting of ten pawns, one king, one queen, two rooks, two bishops, two knights and at least two additional pieces. In a preferred embodiment the two additional pieces are identical and can move a maximum of three squares in any direction. The additional pieces are preferably adapted to represent dragons.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

The patent or application file contains at least one drawing executed in color. Copies of this patant or patent application publication with color drawing(s) will be provided by the Office upon request and payment of the necessary fee.

DETAILED DESCRIPTION OF THE PREFERRED EMBODIMENT

Figure 1:
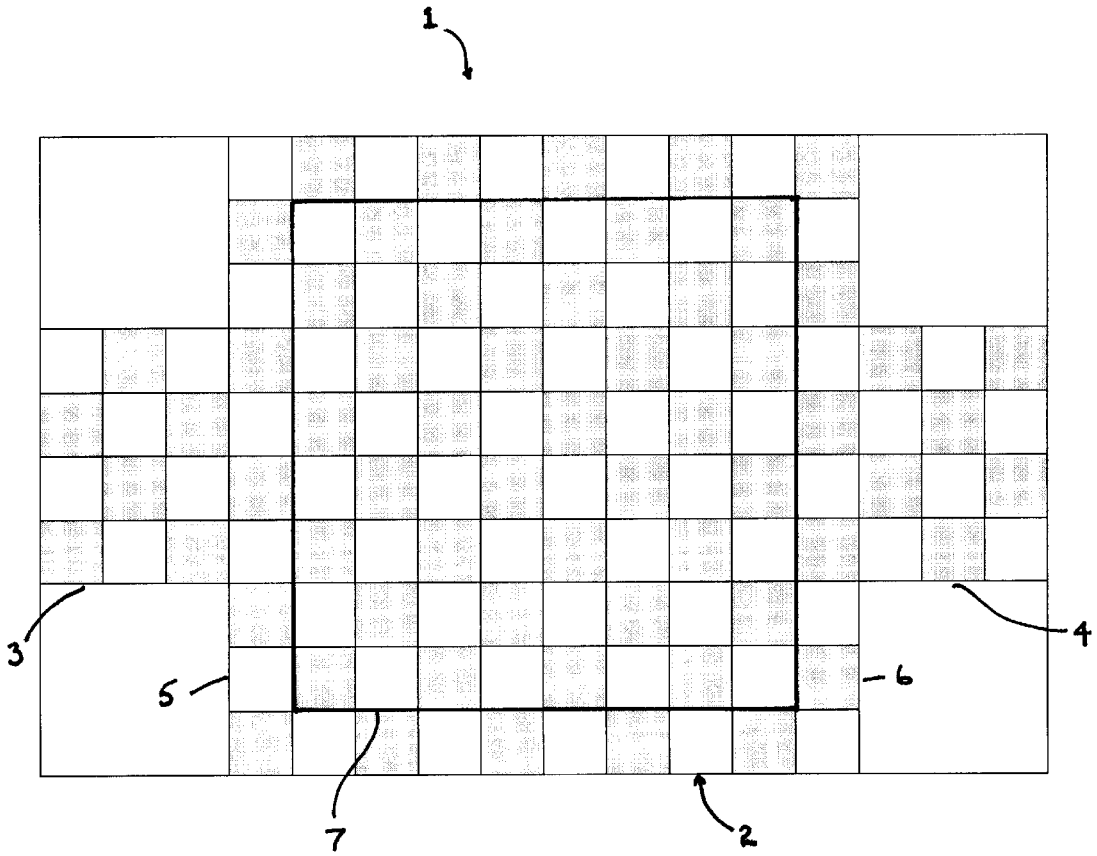
FIG. 1 is a top plan view of a modified chessboard according to the present invention.
Figure 2:
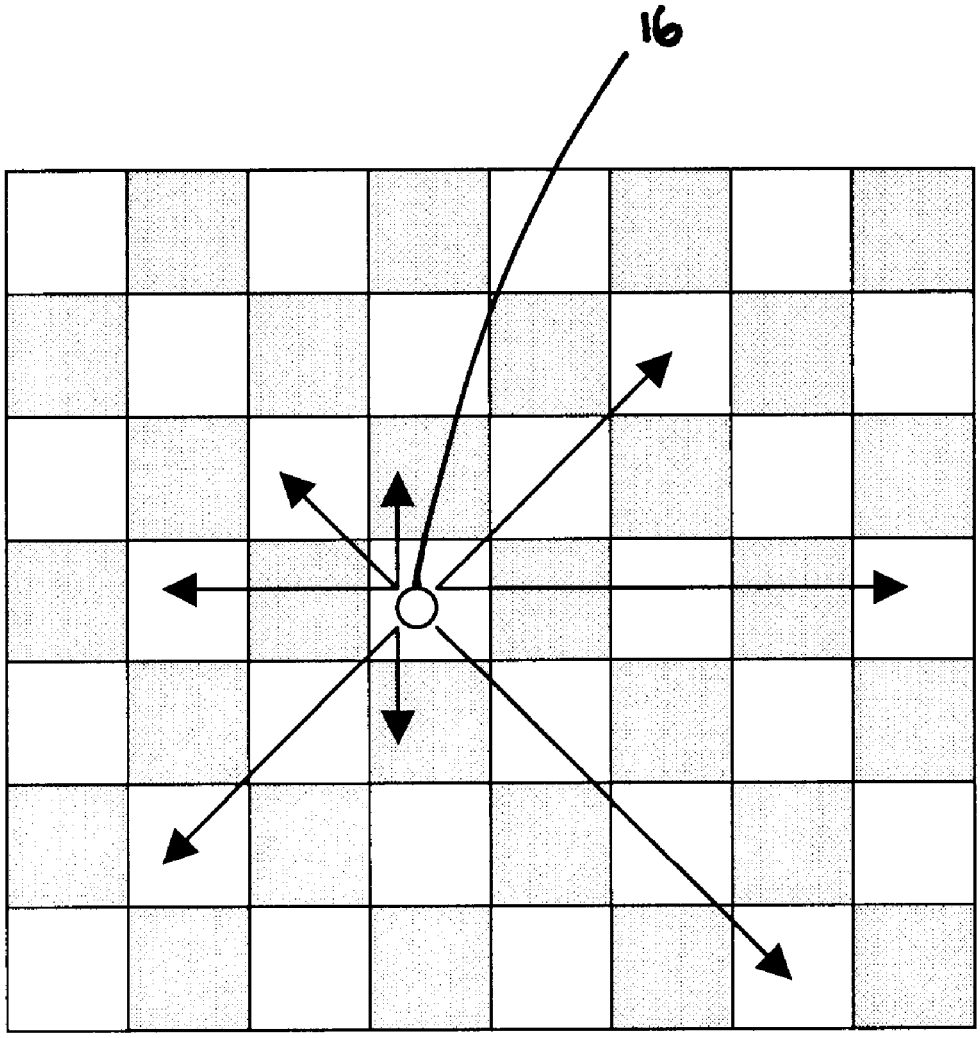
FIG. 2 is a top plan view of a section of the board of FIG. 1 showing the restricted movement of a new playing piece for use on the board of FIG. 1.
Figure 3:
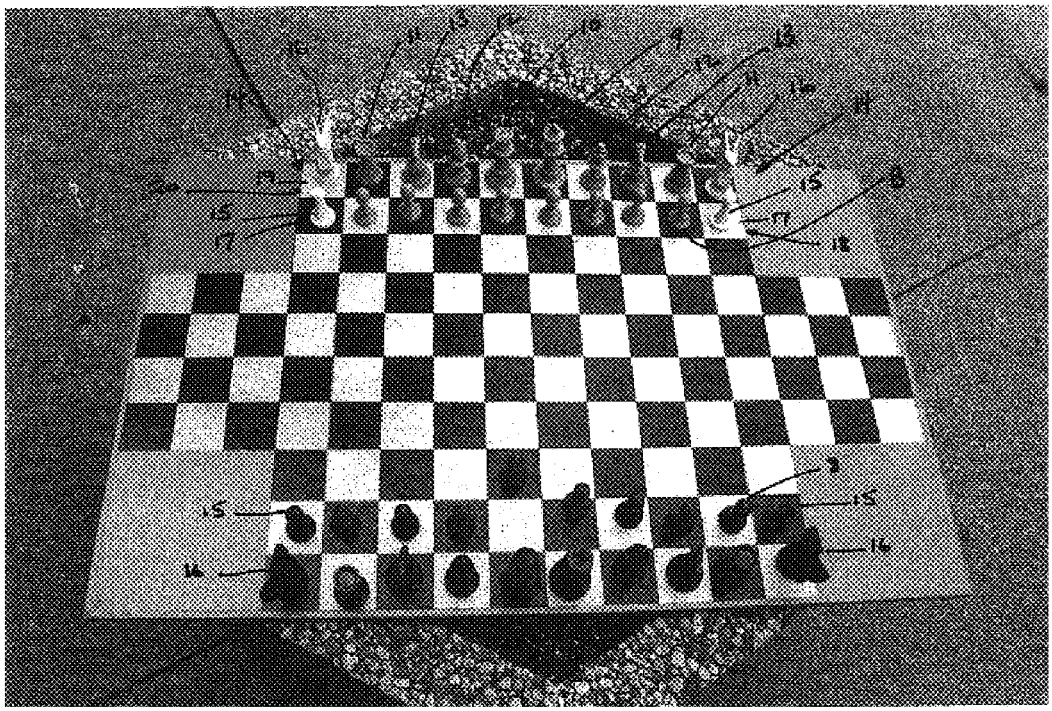
FIG. 3 is a top perspective view of the board of FIG. 1 showing the arrangement of the playing pieces at the start of the game.

Referring to FIGS. 1 to 3, a modified chessboard according to the present invention is generally indicated at 1. The modified chess board 1 consists of a central section 2 having squares, alternately colored light and dark, arranged in vertical rows and horizontal rows. In the embodiment shown, the central section has one hundred squares arranged in ten vertical rows and ten horizontal rows. While the preferred embodiment shows one hundred squares in the central section more or less squares can be utilized. Two field areas 3,4, each having squares, alternately colored light and dark, arranged in vertical rows and horizontal rows, are located on opposite sides 5,6 of the central section 2. In the preferred embodiment each field section 3,4 has the same number of squares and are centrally located on opposite sides 5,6 of the central section 2. In FIG. 1, each field section 3,4 has twelve squares arranged in three vertical rows and four horizontal rows.

In the preferred embodiment the traditional playing field 7 of sixty-four squares is highlighted by a bold border around the area so that the modified board can be used to play a traditional game of chess or the new modified version of the present invention. Other methods of highlighting the traditional playing field 7 of sixty-four squares is possible including shading or the use of different colors, still alternately light and dark, for the squares.

The object of the modified version of the present invention is the same as traditional or classic chess: to corner and checkmate an opponent's King. As shown in FIG. 3, each player has the traditional sixteen pieces (eight pawns 8, king 9, queen 10, two rooks 11, two bishops 12 and two knights 13) plus four additional pieces 14, two pawns 15 and two other pieces 16 which the present inventor has designated "dragons". While the preferred embodiment utilizes the image of dragons for new pieces 16 to fit into the medieval theme of traditional chess other images are possible. The movement of each of the pieces 8–13 remains the same as traditional chess. The two new pawns 15 move exactly the same as the other pawns 8. They are placed on the board 1 at the end 17 of the second row 18 in front of each player. The two dragons 16 are able to move a maximum of three spaces in any direction as shown in FIG. 2. The dragons 16 are placed at each end 19 of the first row 20 in front of each player at the start of the game.

The addition of the four new pieces 14 per player, and in particular the dragons 16, as well as the expanded number of squares on the board present changes to the complexity, dynamics and strategy of the game. No longer will well known, tried and true opening moves and counter moves be sufficient as players explore the impact of the expanded field of play and impact of the new pieces. The challenge of adapting to these changes and twists, while maintaining the basics of traditional chess, result in the present invention providing enhanced enjoyment levels for chess enthusiasts, young and old.

Having illustrated and described a preferred embodiment of the invention and certain possible modifications thereto, it should be apparent to those of ordinary skill in the art that the invention permits of further modification in arrangement and detail. For example, the kind or number of additional pieces per player can be changed. Fewer or more pieces can be used or fewer or more kinds of players can be used. In addition the movement of each kind of additional piece can be modified. All such modifications are covered by the scope of the invention.

The embodiments of the invention in which an exclusive property or privilege is claimed are defined as follows:

1. A method of playing chess comprising the steps of:

providing a chessboard comprising a center section, a first rectangular field area and a second rectangular field area and having a periphery, the center section having a top edge, a bottom edge and first and second side edges connecting said top edge and said bottom edge;

the first field area extending from said center section and comprising a top edge defined by said periphery, a bottom edge defined by said periphery, a first side edge defined by said periphery and a second side edge, said second side edge being contiguous with said center section first side edge;

the second field area extending from said center section and comprising a top edge defined by said periphery, a bottom edge defined by said periphery, a first side edge contiguous with said center section second side edge, and a second side edge defined by said periphery; and a plurality of squares arranged in vertical rows running from said center section top edge to said center section bottom edge and horizontal rows running perpendicular to said vertical rows;

said chessboard including no more than ten squares in any vertical row, at least five horizontal rows having no more than ten squares, and at least one but no more than four horizontal rows having more than ten squares; and providing a set of playing pieces for each one of a plurality of players, each said set comprising a plurality of pawns, a king, a queen, two rooks, two bishops, two knights and at least one additional piece;

each of the plurality of players making a move of one of the playing pieces;

wherein each move of the king, the queen, the bishop, the rook, the knight and the plurality of pawns follow the rules of conventional chess; and wherein each move of the at least one additional piece is selected from the group consisting of all and only the following moves: ones square in any single direction, two squares in any single direction and three squares in any single direction.

2. The method of playing chess according to claim 1 wherein said center section on said chessboard is square.

3. The method of playing chess according to claim 2 where said horizontal rows on said first field area on said chessboard are aligned with said horizontal rows on said second field area.

4. The method of playing chess according to claim 2 wherein all said horizontal rows on said first field area are aligned with all said horizontal rows on said second field area.

5. The method of playing chess according to claim 1 wherein said at least one but no more than four horizontal rows having more than ten squares on said chessboard comprises exactly four horizontal rows.

6. The method of playing chess according to claim 1 wherein said at least five horizontal rows having no more than ten squares on said chessboard comprises six horizontal rows having no more than ten squares.

7. The method of playing chess according to claim 1 wherein said first field area comprises no more than twelve squares.

8. The method of playing chess according to claim 1 wherein an eight by eight sub-chessboard is demarcated on said center section of said chessboard.

9. The method of playing chess according to claim 1 wherein said plurality of squares on said chessboard comprises alternating squares of different colors.

* * * * *